US008783529B2

(12) United States Patent
Dumplet Nunez

(10) Patent No.: US 8,783,529 B2
(45) Date of Patent: Jul. 22, 2014

(54) MODULAR ORGANIZER

(76) Inventor: Elsa Dumplet Nunez, Brentwood, NY (US)

( * ) Notice: Subject to any disclaimer, the term of this patent is extended or adjusted under 35 U.S.C. 154(b) by 213 days.

(21) Appl. No.: 13/548,216

(22) Filed: Jul. 13, 2012

(65) Prior Publication Data

US 2013/0015216 A1 Jan. 17, 2013

Related U.S. Application Data

(60) Provisional application No. 61/507,131, filed on Jul. 13, 2011.

(51) Int. Cl.
*A47G 25/18* (2006.01)
*A47F 5/00* (2006.01)
*A47G 25/40* (2006.01)

(52) U.S. Cl.
USPC ..... 223/88; 211/113

(58) Field of Classification Search
USPC ..... 223/85–96; 211/85.2, 85.7, 13.1, 113; D6/317, 326; 248/339, 340
See application file for complete search history.

(56) References Cited

U.S. PATENT DOCUMENTS 365,389 A * 6/1887 Koegel ..... 211/30
1,858,653 A * 5/1932 Willcox ..... 211/113
1,982,166 A * 11/1934 Hultquist ..... 223/85
2,391,661 A * 12/1945 Watkins et al. ..... 223/88
3,355,030 A * 11/1967 Cathcart ..... 211/88.04
4,317,522 A * 3/1982 Garrett ..... 211/113
5,020,677 A * 6/1991 Wirth et al. ..... 211/113
5,118,065 A * 6/1992 Becklund et al. ..... 248/316.5
D353,292 S * 12/1994 Mariani et al. ..... D6/513
6,123,238 A 9/2000 Dumplet
7,182,232 B2 * 2/2007 Fleming et al. ..... 223/88
7,293,664 B2 * 11/2007 Belokin et al. ..... 211/113

* cited by examiner

*Primary Examiner* — Ismael Izaguirre
(74) *Attorney, Agent, or Firm* — Mark M. Friedman

(57) ABSTRACT

A modular organizer comprises a chain, a plurality of shoulder piece assemblies separable from the chain each comprising separable first and second shoulder pieces made of an elongated body, a first arcuate end and a second arcuate end, the first and second shoulder pieces may have opposing orientations such that one has its arcuate ends facing up and the other has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly. The shoulder piece assembly may appear as a substantially flat ellipse. Each elongated body of at least a plurality of shoulder piece assemblies may traverse an aperture in a link of the chain.

23 Claims, 7 Drawing Sheets

MODULAR ORGANIZER

FIELD AND BACKGROUND OF THE INVENTION

According to a Jul. 29, 2009 press release by the Freedonia Group, a publisher of market research on various business industries, the $7.2 billion home organization products industry is continuously looking for apparatuses and method to reduce the cost for launching setups into homes. U.S. demand for home organization products will rise 4.3 percent annually through 2013. Bins, baskets and totes will remain the largest group while modular units grow the fastest. Garage units will overtake family room products as the second largest segment, with closet organizers also doing well; therefore, formulating alternatives that could make the savvy client happy might not be a bad idea. There is a need for a positive change regarding "dangles" in the organizing industry.

With crowded cities, and small apartments, many residences have a shortage of closet space for clothing. The lack of space for organizing clothing and other articles leads to overpacking of luggage for travel. This costs a lot of extra travel duties. Not having fully organized apparel, accessories and other articles also increases the time and burden of packing and hence of travelling.

In addition, many accessories and articles do not fit neatly into cubbies. Furthermore, traditional cubic-shaped organizers of folder clothing are not portable and occupy a lot of three-dimensional space in an apartment. They do not lend themselves to being positioned other than in specific places in a room. Furthermore, many prior art home organizers are expensive or complicated to install and in some case would require a contractor to physically install in the home. For example, large, complex dangle products are expensive to produce and install.

Another issue is that many consumers want their homes to have products in their homes to be ecologically friendly. One example of this is reduction of carbon emissions.

There have previous attempts in the prior art to overcome the disadvantages of the prior art. For example, there is a multipositional apparatus for hanging things described in U.S. Pat. No. 6,123,238. However, this apparatus does not satisfy the objectives of the organizing industry. Besides not being ecologically friendly, since it is made of metal, this apparatus cannot be easily disassembled and is generally not able to be custom-tailored for different spaces. It also lacks versatility for the many categories of articles that need to be organized.

As can be seen, there is a compelling need for organizers that overcome the disadvantages of the prior art and are inexpensive, simple to manufacture, install and use, ecologically friendly, efficient in space-saving, and versatile in the number of articles they can handle for a given amount of space.

SUMMARY OF THE PRESENT INVENTION

One aspect of the present invention is a modular organizer, comprising a first chain; a second chain; a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first and second chains.

A further aspect of the present invention is a modular organizer, comprising a chain, a plurality of shoulder piece assemblies separable from the chain, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing an aperture in a link of the chain.

A still further aspect of the present invention is a modular organizer, comprising a first chain; a second chain; a central chain; a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first, second and central chains.

Another aspect of the present invention is a modular organizer, comprising a first rod having a series of apertures spaced apart by a first distance; a second rod having a series of apertures spaced apart by the first distance; a plurality of shoulder piece assemblies separable from the first and second rods, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing corresponding apertures of the first and second rods.

A still further aspect of the present invention is a modular organizer, comprising a first chain; a second chain; one or more further chains; a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first chain and the second chain, each elongated body of each shoulder piece of a plurality of shoulder piece assemblies traversing apertures in corresponding links of the second chain and a third chain, the third chain being a chain of the one or more further chains.

These and other features, aspects and advantages of the present invention will become better understood with reference to the following drawings, descriptions and claims.

BRIEF DESCRIPTION OF THE DRAWINGS

Various embodiments are herein described, by way of example only, with reference to the accompanying drawings, wherein.

DETAILED DESCRIPTION OF THE INVENTION

Figure 1:
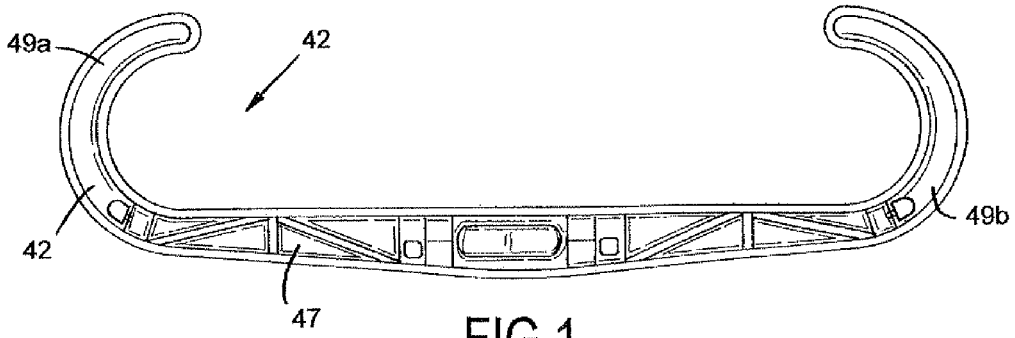
FIG. 1 is a front view of a shoulder piece for an organizer, in accordance with one embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a modular organizer that has one or more chains and a plurality of shoulder piece assemblies. The shoulder piece assemblies may comprise a first shoulder piece and a second shoulder piece, each of the first and second shoulder pieces comprising an elongated body, a first arcuate end and a second arcuate end, the first and second shoulder pieces separable from one another. The arcuate ends of each shoulder piece may both curve up or may both curve down. In each shoulder piece assembly, if the first shoulder piece has the two arcuate ends curved up, then the second shoulder piece may have its two arcuate ends curved down. Accordingly, the first and second shoulder pieces of each shoulder piece assembly may have opposing orientations, once inserted into the chains, such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse.

Each elongated body of each shoulder piece of at least a plurality of shoulder piece assemblies may traverse apertures in corresponding links of the chain or chains. The chain or chains may have hooked top ends that may incorporate an elastic closure that may convert the hook end into an annulus. Locking elements may be used to keep the elongated body of the shoulder piece assemblies secured to the chain or central chain. Other embodiments may use rods with a series of spaced apertures instead of chains. Each shoulder piece assembly may be useful for a variety of different organizing tasks (i.e. hanging, folding, displaying etc.). The shoulder piece is called by that name because one use of the hooks on a shoulder piece is to hang garments at the shoulder portions of such garments.

In contrast to prior art apparatuses for hanging things, such as the apparatus described in U.S. Pat. No. 6,123,238, the organizer of the present invention may be modular and its parts may be disassembled. In further contrast to this prior art apparatuses of hanging things, the organizer of the present invention may effectively double the number of positions from which an article, such as clothing, may be hung flat the way a pair of pants is hung. In still further contrast to the aforementioned apparatus, the organizer of the present invention may allow more secure hanging of articles by utilizing a horizontal band that may be secured to apertures in the shoulder pieces. The horizontal bands may hold a hanging garment to the elongated body of a shoulder piece assembly. In contrast to the prior art, in which an organizer may be for one type of article, the organizer of the present invention may accommodate a variety of different articles. Pants or other apparel placed flat may be placed over the elongated bodies and jacket, shirts and other articles hung on hangers may be wrapped around the top shoulder piece of a shoulder piece assembly. In further contrast to prior art organizers, the organizer of the present invention may be custom-tailored to any space. To take a few examples, the organizer of the present invention may be folded into a suitcase, or using the hooks at the top ends of the chain or chains may be hung on the back of a door, hung in a closet, hung from a cross-bar at the top of a wall, hung from a net. Furthermore, since the chains of the organizer of the present invention are made from plastic that while rigid, may be cut with appropriate cutting tools, such as a clipper or strong scissors, the size of the organizer can be shortened to fit a particular space, as necessary. In further contrast to the prior art organizers, for example a dresser or a closet, which occupy precious three-dimensional space, the organizer of the present invention may save storage space and cost. In further contrast to the prior art, where a suite may be hung in a closet and second suit hung next to the first suit, the organizer may make use of vertical space by having a series of points in vertical space on which articles such as suit jackets may be hung. This may allow the full vertical dimension of a given space to be exploited. In further contrast to the prior art, the organizer of the present invention may be versatile enough to accommodate jackets and other items that are normally hung on shaped hangers. In addition, the organizer can accommodate hanging and organizing accessories of all kinds. Furthermore, by using the elastic band closure on the hook located at the top ends of the chain or chains of the organizer, the entire organizer may be situated high above the ground and lowered for use as desired by simply pulling it down by stretching the elastic band on the hook.

The principles and operation of a method and system for a modular organizer according to the present invention may be better understood with reference to the drawings and the accompanying description.

The organizer of the present invention may be called a dangles organizer. It is suitable for any article such as apparel, accessories, etc. It may be cost effective and may utilize ready-to-use carbon-reduced detached modular pieces. It may allow a consumer on their own to build an effective organizer that snaps together. The organizer could have endless shapes, uses and applications.

The elastic cord or band may be placed either in front or in the back of any particular shoulder piece, and it could also be removed at any time, in addition, it could hold pants, skirts and accessories firmly in place; preventing slipping, and wrinkling. The hooks at the top of the chains may be removed by the user.

The organizer of the present invention could help travelers save time and space packing since the entire organizer can be placed into a piece of luggage with the clothes or other articles already on it. When arriving, the entire organizer can be unfolded and hung up using the hooks. This saves folding and packing time and a lot of space.

Accordingly, the present invention may be described as a method of organizing articles for travelling. A first step of the method may be providing an organizer such as any of the embodiments described above. A second step of the method may be positioning articles on the organizer. A third step may be placing the organizer with its articles inside a piece of luggage. A fourth step may be unpacking the organizer and using one or more of removable hooks to hang the entire organizer with the articles into a closet or other back of door or other space at the destination.

The organizer of the present invention may have a real flat appearance. The pieces of the organizer could be ingeniously organized in any suitable position, the chain links could also be fabricated of any suitable material.

As shown in FIGS. 1-4, a modular organizer 10 may comprise a first chain 20, a second chain 30 and a plurality of shoulder piece assemblies 40 separable from the first and second chains. Each chain may have links that may have apertures or holes in the links. In some preferred embodiments, the "plurality" of shoulder piece assemblies means at least seven. In other preferred embodiments, this "plurality" means at least six, or at least five, or at least four, or at least three, or at least two. It could, of course, also mean a higher number than seven. This applies to all embodiments of organizers of the present invention.

Each shoulder piece assembly 40 may comprise a first shoulder piece 42 and a second shoulder piece 44. Each of the first and second shoulder pieces 42, 44 may comprise an elongated body 47, a first arcuate end 49*a* and a second arcuate end 49*b*. For example a shoulder piece assembly 40 may have on the left side of the organizer 10 a first arcuate end 49*a* of the first shoulder piece 42 and a first arcuate end 49*a* of the second shoulder piece 44. The two ends 49*a* may overlap. The same shoulder piece assembly 40 may have on the right side of the organizer 10 a second arcuate end 49*b* of the first shoulder piece 42 and a second arcuate end 49*b* of the second shoulder piece 44 and the two ends 49*b* may overlap. The first and second shoulder pieces 42, 44 may be separate pieces that may be held adjacent to one another but may be separable from one another.

Figure 2:
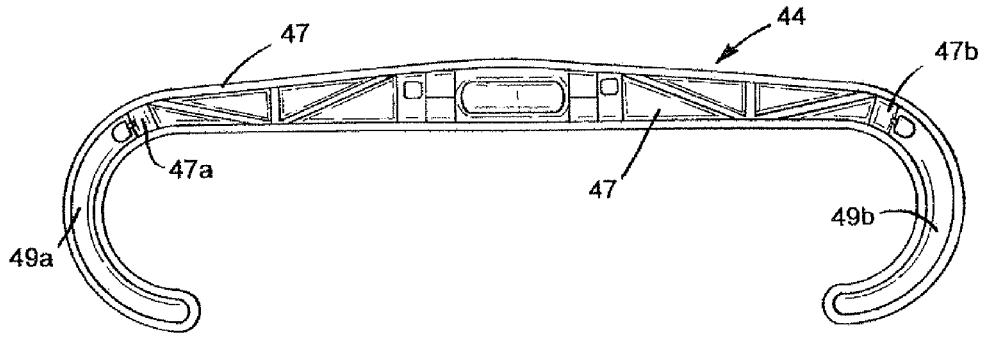
FIG. 2 is a front view of a shoulder piece for an organizer, except pointing down, in accordance with one embodiment of the present invention.
Figure 3:
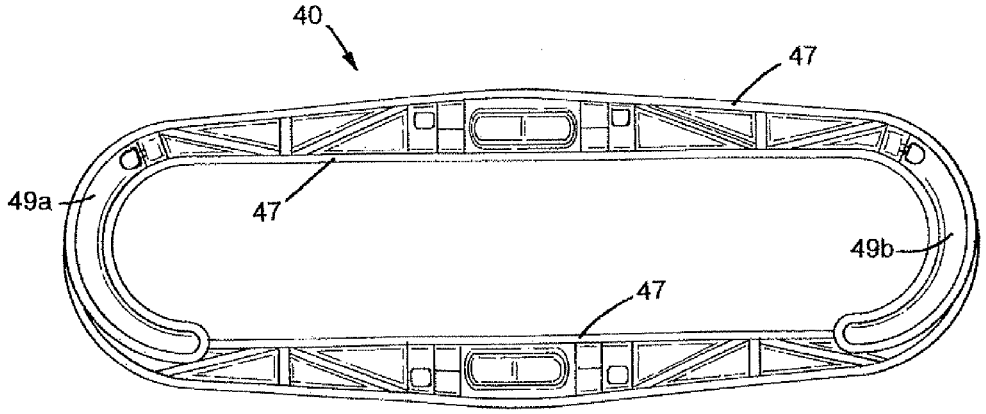
FIG. 3 is a front view of a shoulder piece assembly, in accordance with one embodiment of the present invention.
Figure 4A:
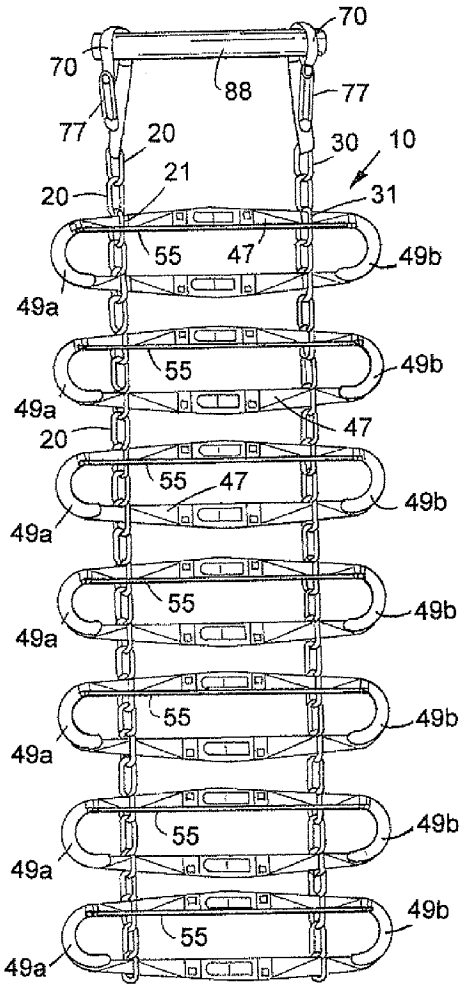
FIG. 4A is a front view of an organizer similar to FIG. 4 and showing elastic bands to secure articles, in accordance with one embodiment of the present invention.
Figure 3A:
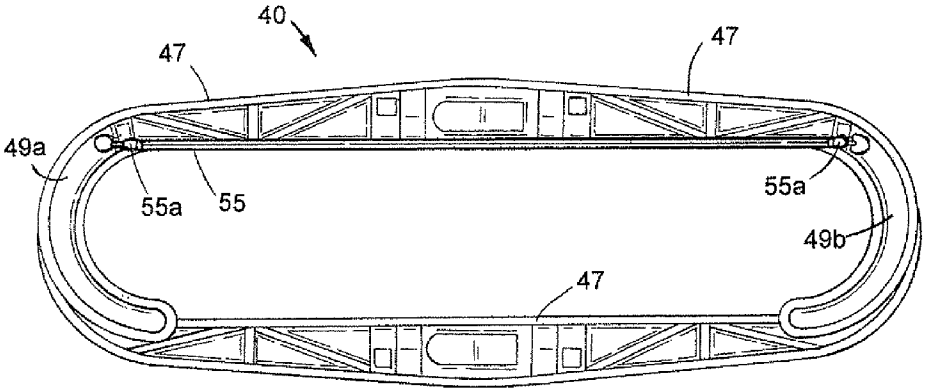
FIG. 3*a* is a front view similar to FIG. 3 also depicting the elastic band 55.

As seen from the drawings, particularly FIGS. 1-2, "arcuate" ends may be described as hooks that are similar in shape to an umbrella handle. In some preferred embodiments, the arcuate ends may be less than a full semi-circle. In other preferred embodiments, the arcuate ends may be a full semi-circle or substantially semi-circular. In still other preferred embodiments, the arcuate ends may be J-shaped. In other preferred embodiments, the arcuate ends may be as shown in the drawings. In still other preferred embodiments, each of the arcuate ends may be less than 180 degrees in circular rotation (for example 120 degrees, 140 degrees, 160 degrees) provided that the arcuate end 49*a* of a first shoulder piece 42 overlaps with the arcuate end 49*b* of the second shoulder piece 44 of the same shoulder piece assembly 40 when the two shoulder pieces 42, 44 are placed adjacent one another, as they appear when in position for use, such as shown in the drawings.

Figure 5:
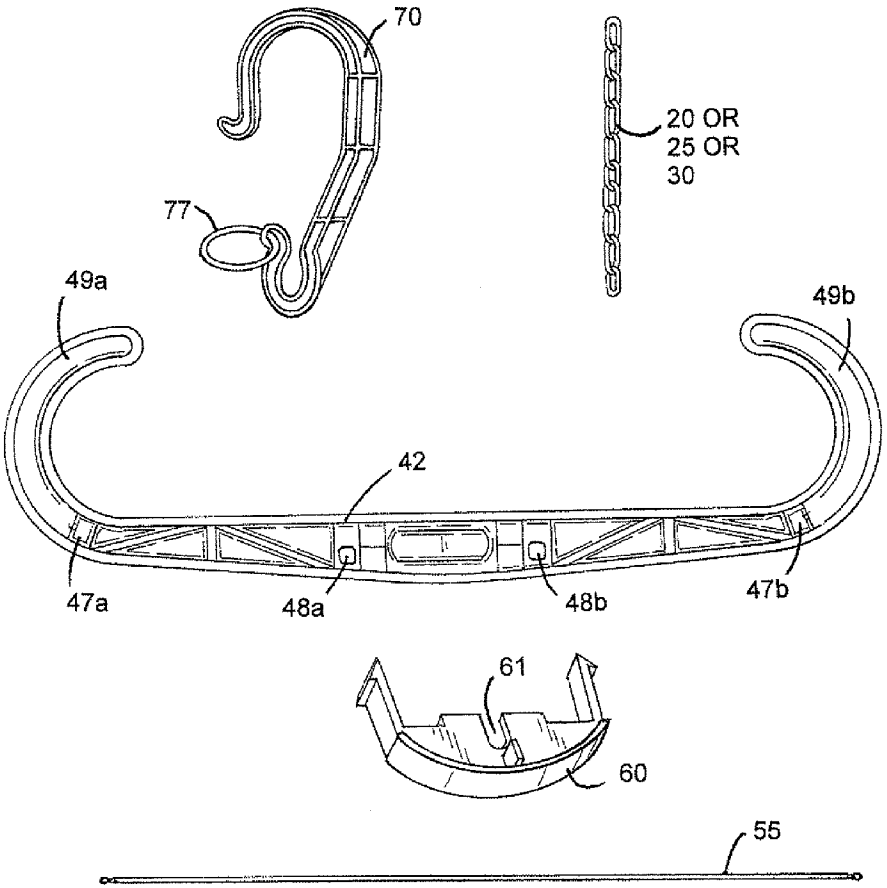
FIG. 5 shows elements of an organizer including a locking element for locking a shoulder piece to a chain, in accordance with one embodiment of the present invention.
Figure 4:
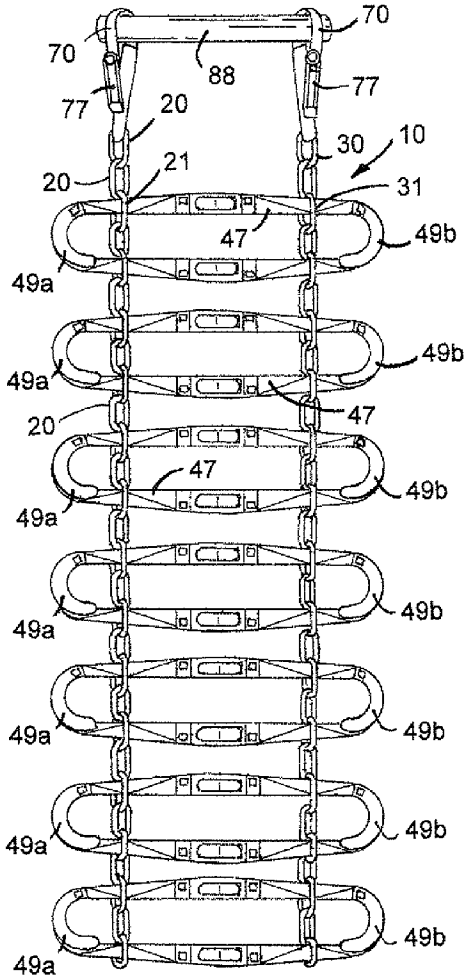
FIG. 4 is a front view of an organizer, in accordance with one embodiment of the present invention.

The two shoulder pieces 42, 44 of shoulder piece assembly 40 need not be fixedly attached to one another although they may generally hang in a manner that may be adjacent to one another. In preferred embodiments, the shoulder pieces are fixedly attached to one another by a locking element 70. FIG. 5 shows the elements of this for a single chain organizer.

Although in preferred embodiments, each arcuate end of one shoulder piece 42, 44 may be similar or identical the arcuate end of the other shoulder piece of the shoulder piece assembly, there could be some variation if the overall shoulder piece assembly 40 is stable.

The first and second shoulder pieces 42, 44 of each shoulder piece assembly 40 may have opposing orientations such that one of the first and second shoulder pieces 42, 44 may have its arcuate ends 49*a*, 49*b* facing up and the other of the first and second shoulder pieces 42, 44 may have its arcuate ends 49*a*, 49*b* facing down. As can be seen from FIG. 10, the first arcuate end 49*a* of the first shoulder piece 42 may be situated adjacent the first arcuate end 49*a* of the second shoulder piece 44 of each shoulder piece assembly 40 (or, in other preferred embodiments, of a majority, or of a plurality, or of fewer than every single shoulder piece assembly 40) and the second arcuate end 49*b* of the first shoulder piece 42 situated adjacent the second arcuate end 49*b* of the second shoulder piece 44 of each shoulder piece assembly (or, in other preferred embodiments, of a majority, or of a plurality, or of fewer than every single shoulder piece assembly 40) so that the shoulder piece assembly 40 as a whole appears as a substantially flat ellipse. The two elongated bodies 47 may form two substantially parallel lines and the two pairs of arcuate ends may form arcs. Assembly 40 need not bulge out at its center like an ellipse but may be flatter. This may make it comfortable to hang articles of clothing, for example, on substantially straight elongated bodies 47 of assembly 40. In preferred embodiments, elongated bodies 47 are substantially straight.

In other preferred embodiments, the elongated bodies 47 may be somewhat arced provided clothing, such as a pair of pants, would not slide off it. The typical way a pair of pants would be placed on the elongated body is that the pants would be folded along the creases and then neatly placed on the elongated body with the top of the pants hanging down one side and the bottom of the pants hanging down another side of the elongated body 47. As described below, an elastic band may hold the pants or other article to the elongated body.

Figure 16:
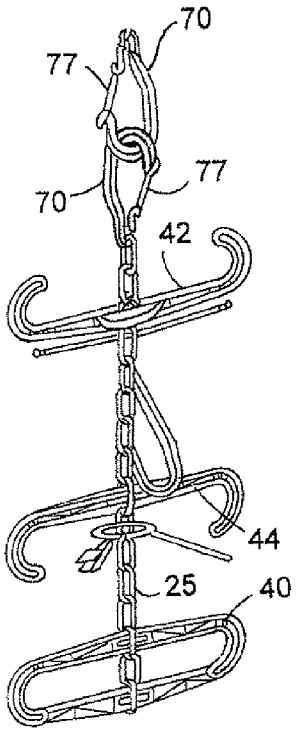
FIG. 16 is a view of an organizer showing a shoulder piece assembly and individual shoulder pieces and showing hooks containing elastic bands, in accordance with one embodiment of the present invention.

As shown in FIG. 16, the shoulder pieces that may be used in multiple organizing tasks may also be hung in either direction, allowing unlimited freedom to set up garment styles and positions. Also, the chain links may be bendable and fully adaptable in length and size and could be manufactured to support around 80 pounds, more than a regular full piece of luggage.

Each elongated body 47 of each shoulder piece 42, 44 of each of the assemblies 40, or of at least a plurality (or of a majority, or of at least three, or of at least five, or of at least seven, in other preferred embodiments) of shoulder piece assemblies 40 may traverse the apertures in corresponding links 21, 31 of the first and second chains 20, 30. Typically, the links of each chain 20, 30 are spaced apart and are of the same size in each chain 20, 30.

The top of each chain may have a hook 70 that may be operatively engaged with a cross-piece or cross-piece assembly. In some embodiments, the assembly may include the cross-piece or cross-piece assembly (which may be located at or near a top of the chains) and the two chains may hang from such a cross piece or cross piece assembly, for example via their respective hooks. In other embodiments, the cross-piece or cross-piece assembly may not be part of the assembly. Furthermore, the assembly may be engaged to a cross-piece of a fixed structure, such as a cross-bar of a closet.

Figure 10:
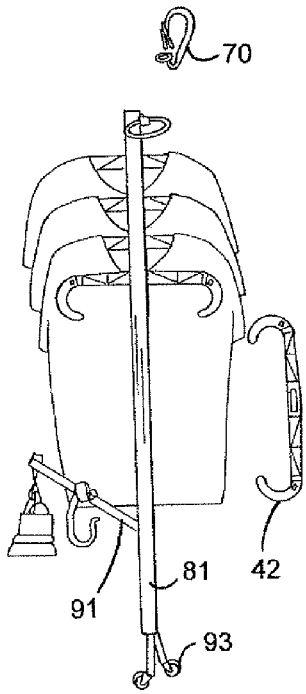
FIG. 10 is a schematic view of an organizer made of rods and shoulder pieces holding articles, in accordance with one embodiment of the present invention.
Figure 11:
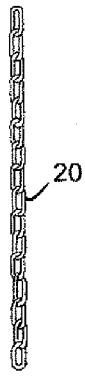
FIG. 11 is a front view of a chain for an organizer, in accordance with one embodiment of the present invention.

As can be seen from FIG. 10, each of the first chain 20 and the second chain 30 may also have a hooked top end for mounting on a cross-bar. The cross-bar 88 itself may in some preferred embodiments be included as part of the organizer 10 (which may be located at or near a top of the chains) and may connect the hooked top ends of the chains. The hooked top end 70, which may be removable, may include a stretchable elastic piece 77, such as Spandex, that may effectively convert the hooked top end of each chain from an open arc into an annulus. This may allow the entire organizer to be held by the hook and thereby be pulled down by the user from a storage place high off the floor to a conveniently reachable position for insertion or removal of articles by the user. Yet at the same time this may allow the organizer, after the elastic is released, to be positioned for storage at a height that may minimize occupation of essential usable space in a residence. The hook 70 affixed at the top ends of the respective first and second chains may be removable.

Any suitable fastening means may be used to hold the two shoulder pieces 42, 44 together as part of a single shoulder piece assembly 40. A locking element 60, such as the locking plate shown in FIG. 5 for holding a shoulder piece to a chain, may also be used to hold corresponding elongated bodies of the two shoulder pieces of shoulder piece assembly 40 together. To accomplish this, the elongated bodies 47 may have apertures, for example left and right apertures 48*a*, 48*b*, for fastening a locking element 60 to the elongated body 47. Alternatively, a suitable fastening structure (not shown) may be inserted through apertures at the ends 47*a*, 47*b* of the elongated body 47 or some other closure means may be used at a different point along elongated body 47 to keep the two shoulder pieces together.

As shown in FIG. 5, in order to hold garments that are hanging from elongated bodies 47 of the assemblies 40 of the organizer 10, the organizer 10 may further comprise an elastic band 55 affixed to left and right ends 47*a*, 47*b* of at least one elongated body 47 of a plurality of (or of a majority or all or at least three or at least five or at least seven, in other preferred embodiments) each shoulder piece assembly 40. For example, the elongated body 47 traversing the bottom link may have a horizontal elastic band 55 that may hold a garment that is hanging on the elongated body securely between the band 55 and the elongated body 47. The elastic band 55 may be affixed to a shoulder piece's elongated body 47 for example by having small projection 55*a* at ends 47*a*, 47*b* to catch the band 55 on. Other means may be used.

Figure 7:
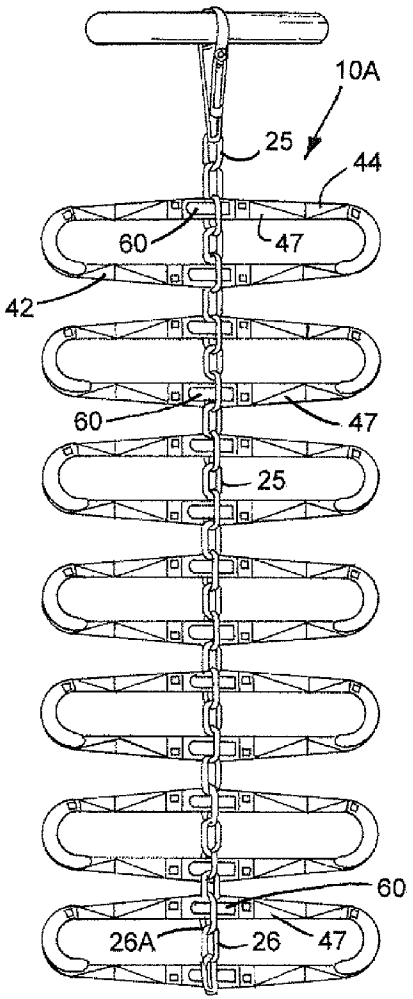
FIG. 7 is a front view of an organizer having one chain, in accordance with one embodiment of the present invention.

The present invention, as seen in FIG. 7, may also be described as a modular organizer 10A comprising a single chain 25. The organizer may also have, as before, a plurality of shoulder piece assemblies separable from the chain 25, each shoulder piece assembly comprising a first shoulder piece and a second shoulder piece, each of the first and second shoulder pieces comprising an elongated body, a first arcuate end and a second arcuate end. As with the embodiment with two chains, the first and second shoulder pieces may be separable from one another, the first and second shoulder pieces 42, 44 of each shoulder piece assembly 40 may have opposing orientations such that one of the first and second shoulder pieces may have its arcuate ends facing up and the other of the first and second shoulder pieces may have its arcuate ends facing down, the first arcuate end of the first shoulder piece may be situated adjacent the first arcuate end of the second shoulder piece of each shoulder piece assembly and the second arcuate end of the first shoulder piece may be situated adjacent the second arcuate end of the second shoulder piece of each shoulder piece assembly so that the shoulder piece assembly as a whole may appear as a substantially flat ellipse. Each elongated body 47 of each shoulder piece 42, 44 of at least a plurality (in other preferred embodiments of a majority or at least three or at least five or at least seven or all) of shoulder piece assemblies 40 may traverse an aperture in a link of the chain.

Figure 6:
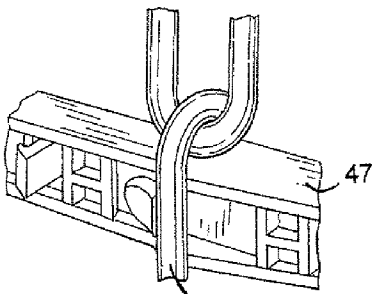
FIG. 6 is a fragmentary perspective view showing one way of locking a chain to a shoulder piece of an organizer, in accordance with one embodiment of the present invention.

As shown in FIG. 5, the elongated body of the shoulder piece may contain apertures 48*a*, 48*b* that may mate with male members or prongs of a locking element shown in FIG. 5. Since the locking element 60 may have a central aperture 61 into which a dangling chain may fit, this may allow each shoulder piece 42, 44 to be held fixedly against a portion of the chain (20 or 25 or 30). FIG. 6 shows a shoulder piece in the midst of being locked into place with the chain beginning to be caught between the locking element 60 and the shoulder piece.

As seen from FIG. 5, any of the organizers of the present invention that use chains (i.e. organizers, 10, 10A, 10B) may also comprise a plurality of locking elements 60, each locking element 60 affixing an elongated body to the chain 25. For example, each locking element 60 may have a fastening means such as a central aperture 61 for receiving a link 26 of the chain 25 and for holding that link 26 of the chain 25 tightly between the locking element 60 and the elongated body 47 that traversed the aperture 26*a* in that link 26 of the chain 25. Each elongated body 47 may also have left and right apertures 48*a*, 48*b* for fastening the locking element 60 to the elongated body 47 traversing the aperture 26A in the link 26 of the chain 25. As described with respect to the embodiment with two chains, the organizer 10A may also have a removable hook affixed to a top end of the chain, and the hook may have a stretchable elastic converting the hook into an annulus.

Figure 8:
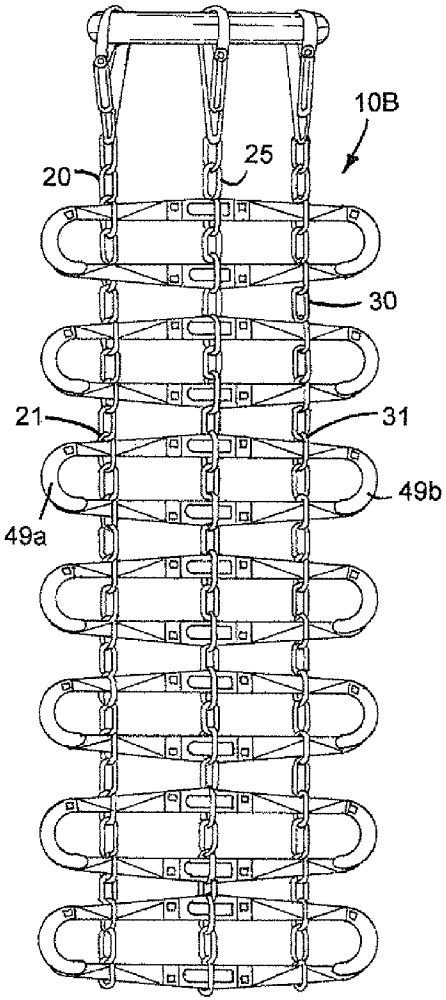
FIG. 8 is a front view of an organizer having three chains, including a central chain, in accordance with one embodiment of the present invention.

As shown in FIG. 8, the present invention may also be described as a modular organizer 10B that has three chains. For example organizer 10B may comprise a first chain 20, for example on side, a second chain 30 for example on the other side, and a central chain 25 for example in the middle of the two other chains. Organizer 10B may also have a plurality of shoulder piece assemblies that may be separable from the chains, especially the first and second chains. As before, organizer 10B may also have shoulder piece assemblies similar to the shoulder piece assemblies 40 of organizer 10 and 10A. For example the assembly 40 may have a first shoulder piece and a second shoulder piece, each of the first and second shoulder pieces comprising an elongated body, a first arcuate end and a second arcuate end, the first and second shoulder pieces separable from one another. In organizer 10B, each elongated body of each shoulder piece of at least a plurality of shoulder piece assemblies may traverse apertures in corresponding links of the first, second and central chains 20, 25, 30.

The organizer 10B may incorporate any of the other elements described in relation to organizer 10 and 10A. For example, organizer 10B may have a plurality of locking plates, each locking plate affixing an elongated body to the central chain. Each locking plate may have a central aperture for receiving a link of the central chain and holding the link of the central chain tightly between the locking plate and the elongated body traversing an aperture in the link of the central chain. Each locking plate may also have left and right side apertures for affixing the locking plate to the elongated body traversing the aperture in the link of the central chain. An elastic band affixed to left and right ends of the elongated body of each shoulder piece.

The first chain, the second chain and the central chain may have links that are similarly spaced apart and of similar size.

Figure 9:
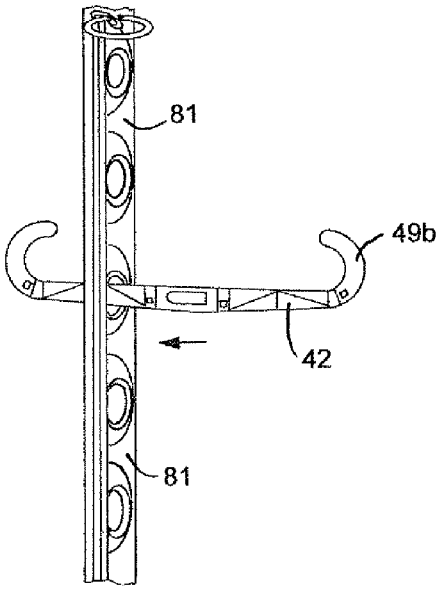
FIG. 9 is a view of a shoulder piece inserted into an aperture of a rod for an organizer using rods instead of chains, in accordance with one embodiment of the present invention.
Figure 12:
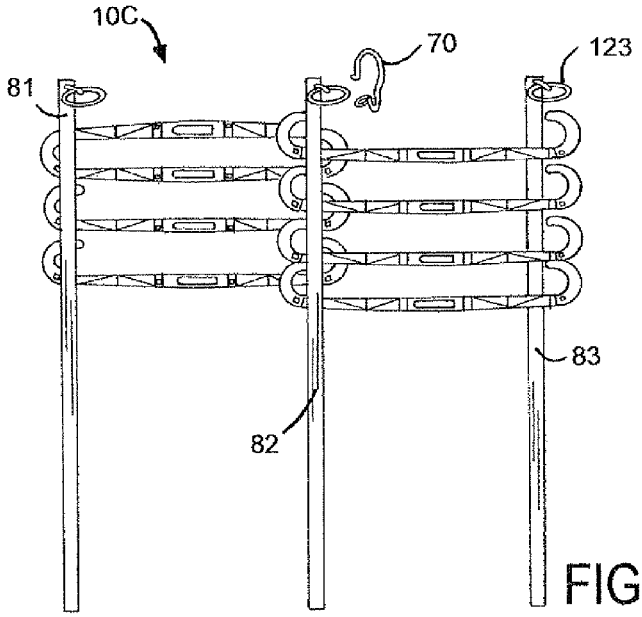
FIG. 12 shows an embodiment in which three rods are connected using two sets of shoulder piece assemblies, in accordance with one embodiment of the present invention.
Figure 13:
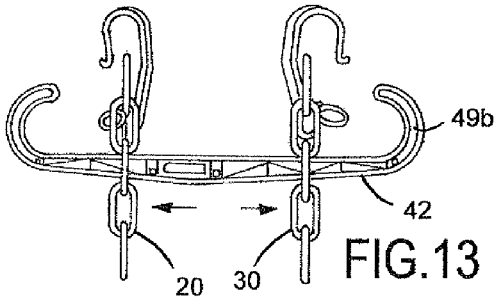
FIG. 13 is a front view showing two chains of an organizer having a shoulder piece between them, in accordance with one embodiment of the present invention.

As shown in FIG. 9 and in FIG. 12, the present invention may also be described as a modular organizer that utilizes rods 81, 82, 83 having apertures instead of chains having links with apertures. For example, organizer 10C may comprise a first rod having a series of apertures spaced apart by a first distance and a second rod having a series of apertures spaced apart by the first distance. Organizer 10C may have a plurality of shoulder piece assemblies 40 separable from the first and second rods. In other respects the shoulder piece assembly 40 may be similar to that in other embodiments, i.e. comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse.

Each elongated body of each shoulder piece of at least a plurality of shoulder piece assemblies may traverse corresponding apertures of the first and second rods.

As shown in FIG. 10, organizer 10C may also comprise one or more wheels 93 attached to a bottom of one or more rods 81. Organizer 10C may also include a projecting rod 91 for additional hanging of accessories.

The organizer 10C may be hung (for example onto a rod across a wall near a ceiling) using an elastic loop 123 or a hook 70, as shown in FIG. 12 in the event that floor space needs to be saved.

As shown in FIG. 12 and FIG. 9, in certain preferred embodiments, organizer 10C may include a third rod having a series of apertures spaced apart by the first distance, each elongated body of each shoulder piece of at least a plurality of shoulder piece assemblies traversing corresponding apertures of the second and third rods.

Figure 14:
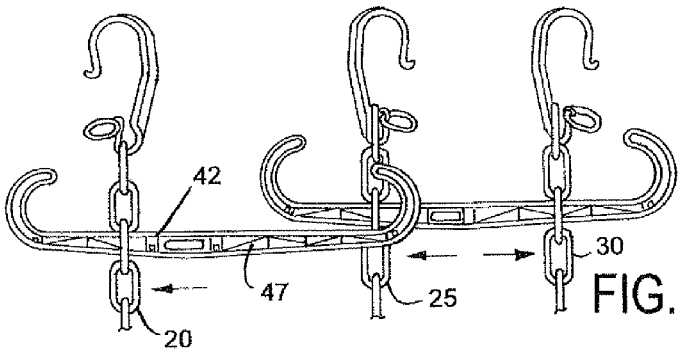
FIG. 14 is a front view showing three chains accommodating two shoulder pieces for an organizer, in accordance with one embodiment of the present invention.
Figure 15:
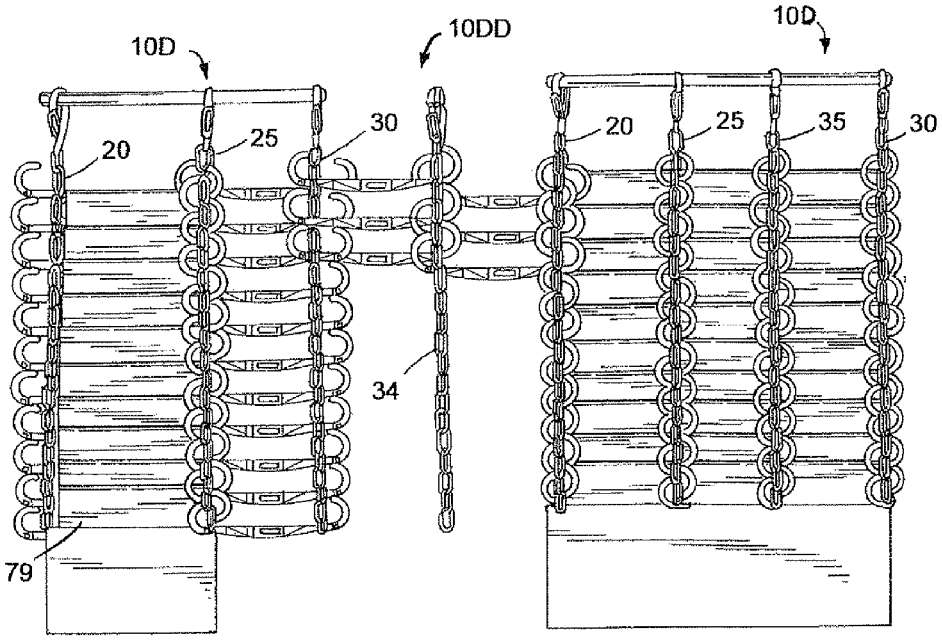
FIG. 15 is a front view showing articles, such as towels 79, hanging on an organizer of three chains and of four chains and showing expansion of the number of chains, in accordance with one embodiment of the present invention.

As shown in FIG. 15, and as partially shown in FIG. 14, the present invention may also be described as a modular organizer 10D comprising a first chain, a second chain and one or more further chains. The structure of the shoulder piece assemblies 40 are as before. Each elongated body of each shoulder piece of at least a plurality of shoulder piece assemblies may traverse apertures in corresponding links of the first chain and the second chain, and each elongated body of each shoulder piece of a plurality of shoulder piece assemblies may traverse apertures in corresponding links of the second chain and a third chain, the third chain being a chain of the one or more further chains.

As shown in FIG. 15, in some preferred embodiments, organizer 10D may also comprise a fourth chain 35 wherein each elongated body of each shoulder piece of at least a plurality of shoulder piece assemblies may traverse apertures in corresponding links of the third chain and a fourth chain, the fourth chain being a chain of the one or more further chains. As shown in FIG. 15, moreover, more than one organizer 10D may be combined together to form a larger organizer 10DD by inserting shoulder pieces through the links of the chains at the sides of the respective organizers or aby adding new chain 34.

As shown in FIG. 16, in some embodiments, only one of the two shoulder pieces of the shoulder piece assembly 40 may be used in the plurality of shoulder piece assemblies, for example the bottom shoulder piece, in which case a complete flat ellipse is not formed. Although this embodiment would not have the advantage of organizer 10 where both the top and the bottom elongated body 47 are available to accommodate placement of an article of clothing, laid flat on the elongated body, a consumer may prefer to have a series of shoulder piece assemblies with all the shoulder pieces oriented with the arcuate ends facing up and a separate organizer with shoulder pieces all of whose arcuate ends face down. In this way, one organizer could be used for pants and the other for jackets.

In any embodiment, each shoulder piece or shoulder piece assembly may provide a separate place for a separate article (i.e. garment) to be organized, hung, folded, displayed, etc. This is not to suggest that a single shoulder piece or shoulder piece assembly cannot be used for multiple articles.

The material of the organizers of the present invention may be any suitable material that is ecologically friendly, lightweight, inexpensive to make, easy to dispose of, not liable to rust, such as plastic. The elastic portions may be made of any suitable elastic such as Spandex. The organizer 10 of the present invention may be able to hold up to 80 pounds of articles.

Figure 17:
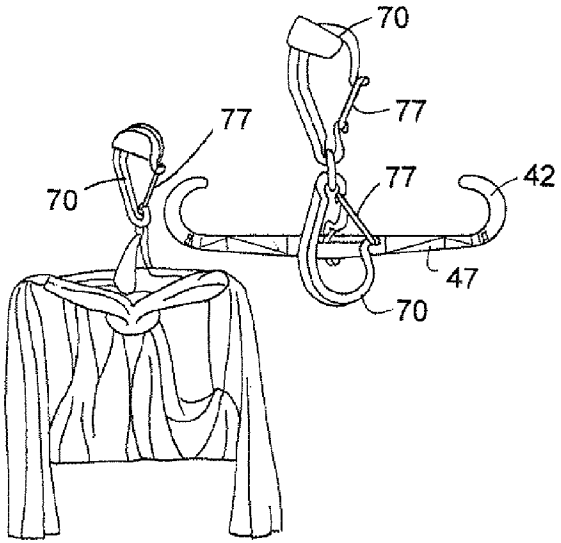
FIG. 17 is a front view of a shoulder piece of an organizer of the present invention connected to a doubled hook 70 by inserting band 77 through an aperture in elongated body 47 and a garment hanging with this structure, in accordance with one embodiment of the present invention.

In certain preferred embodiments, as shown in FIGS. 16-17, two or more hooks 70 can be combined with one another and then further combined with the organizer of the present invention. In general, any of the structures outlined herein may be combined with any of the other structures outlined herein to form more complex or other organizing structures, in accordance with the present invention.

It should be understood, of course, that the foregoing relates to exemplary embodiments of the invention and that modifications may be made without departing from the spirit and scope of the invention as set forth in the following claims.

What is claimed is:

1. A modular organizer, comprising:

a first chain;

a second chain;

a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first and second chains.

2. The organizer of claim 1, further comprising each elongated body of each shoulder piece of each shoulder piece assemblies traversing apertures in corresponding links of the first and second chains.

3. The organizer of claim 1, further comprising each of the first chain and the second chain having a hooked top end for mounting on a cross-bar.

4. The organizer of claim 3, further comprising each hooked top end including a stretchable elastic for converting the hooked top end of each chain into an annulus.

5. The organizer of claim 1, further comprising the first chain and the second chain each having a removable hook affixed to a top end of the respective first and second chains.

6. The organizer of claim 1, further comprising a cross-bar connecting the hooked top ends of the first and second chains.

7. The organizer of claim 1, further comprising the first and second shoulder pieces of each shoulder piece assembly held together affixedly by a locking element.

8. The organizer of claim 1, further comprising each elongated body having apertures for fastening a locking element to the elongated body.

9. The organizer of claim 1, further comprising an elastic band affixed to left and right ends of at least one elongated body of a plurality of shoulder piece assemblies.

10. A modular organizer, comprising:

a chain, a plurality of shoulder piece assemblies separable from the chain, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing an aperture in a link of the chain.

11. The organizer of claim 10, further comprising a plurality of locking elements, each locking element affixing an elongated body to the chain.

12. The organizer of claim 11, further comprising each locking element having a central aperture for receiving a link of the chain and holding the link of the chain tightly between the locking element and the elongated body that traversed an aperture in the link of the chain.

13. The organizer of claim 12, further comprising each elongated body having left and right apertures for fastening the locking element to the elongated body traversing the aperture in the link of the chain.

14. The organizer of claim 11, further comprising a removable hook affixed to a top end of the chain, the hook having a stretchable elastic converting the hook into an annulus.

15. A modular organizer, comprising:

a first chain;

a second chain;

a central chain;

a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first, second and central chains.

16. The organizer of claim 15, further comprising a plurality of locking plates, each locking plate affixing an elongated body to the central chain.

17. The organizer of claim 16, further comprising each locking plate having a central aperture for receiving a link of the central chain and holding the link of the central chain tightly between the locking plate and the elongated body traversing an aperture in the link of the central chain.

18. The organizer of claim 15, further comprising each locking plate also having left and right side apertures for affixing the locking plate to the elongated body traversing the aperture in the link of the central chain.

19. The organizer of claim 15, further comprising an elastic band affixed to left and right ends of the elongated body of each shoulder piece.

20. A modular organizer, comprising:

a first rod having a series of apertures spaced apart by a first distance;

a second rod having a series of apertures spaced apart by the first distance;

a plurality of shoulder piece assemblies separable from the first and second rods, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing corresponding apertures of the first and second rods.

21. The organizer of claim 20, further comprising a third rod having a series of apertures spaced apart by the first distance, each elongated body of each shoulder piece of at least a plurality of shoulder piece assemblies traversing corresponding apertures of the second and third rods.

22. A modular organizer, comprising:

a first chain;

a second chain;

one or more further chains;

a plurality of shoulder piece assemblies separable from the first and second chains, each shoulder piece assembly comprising a first shoulder piece and a second shoulder piece, each of the first and second shoulder pieces comprising an elongated body, a first arcuate end and a second arcuate end, the first and second shoulder pieces separable from one another, the first and second shoulder pieces of each shoulder piece assembly having opposing orientations such that one of the first and second shoulder pieces has its arcuate ends facing up and the other of the first and second shoulder pieces has its arcuate ends facing down, the first arcuate end of the first shoulder piece situated adjacent the first arcuate end of the second shoulder piece of each shoulder piece assembly and the second arcuate end of the first shoulder piece situated adjacent the second arcuate end of the second shoulder piece of each shoulder piece assembly so that the shoulder piece assembly as a whole appears as a substantially flat ellipse, each elongated body of each shoulder piece of at least a plurality of shoulder piece assemblies traversing apertures in corresponding links of the first chain and the second chain, each elongated body of each shoulder piece of a plurality of shoulder piece assemblies traversing apertures in corresponding links of the second chain and a third chain, the third chain being a chain of the one or more further chains.

23. The organizer of claim 22, further comprising each elongated body of each shoulder piece of at least a plurality of shoulder piece assemblies traversing apertures in corresponding links of the third chain and a fourth chain, the fourth chain being a chain of the one or more further chains.

* * * * *